US010895069B1

(12) United States Patent
Tsai

(10) Patent No.: US 10,895,069 B1
(45) Date of Patent: Jan. 19, 2021

(54) AUTOMATIC FLUSH TOILET

(71) Applicant: Tien-Shou Tsai, Taichung (TW)

(72) Inventor: Tien-Shou Tsai, Taichung (TW)

(73) Assignee: Tien-Shou Tsai, Taichung (TW)

( * ) Notice: Subject to any disclaimer, the term of this patent is extended or adjusted under 35 U.S.C. 154(b) by 4 days.

(21) Appl. No.: 16/515,290

(22) Filed: Jul. 18, 2019

(51) Int. Cl.
*E03D 5/10* (2006.01)

(52) U.S. Cl.
CPC ..... *E03D 5/105* (2013.01)

(58) Field of Classification Search
CPC ..... E03D 5/105; E03D 1/186
USPC ..... 4/313, 326
See application file for complete search history.

(56) References Cited

U.S. PATENT DOCUMENTS 4,240,168 A * 12/1980 Duke ..... E03D 1/145 4/326
4,462,124 A * 7/1984 Antos ..... E03D 1/141 4/346
5,950,983 A * 9/1999 Jahrling ..... E03D 5/105 4/313

* cited by examiner

*Primary Examiner* — Tuan N Nguyen
(74) *Attorney, Agent, or Firm* — TraskBritt

(57) ABSTRACT

An automatic flush toilet includes a toilet stool with a toilet bowl, a water tank unit, a first discharge member, a second discharge member, a pipe unit, a flush valve, a manual actuating unit, an electric switching valve, and a sensor control unit. The electric switching valve is controlled by the sensor control unit to permit water discharged from the first discharge member to flush the toilet bowl. The flush valve is controlled by the manual actuating unit to permit water discharged from the second discharge member to flush the toilet bowl.

15 Claims, 18 Drawing Sheets

AUTOMATIC FLUSH TOILET

FIELD

The disclosure relates to a flush toilet, more particularly to an automatic flush toilet.

BACKGROUND

To flush away excreta in a conventional flush toilet, it is normally necessary to press a button or turn a handle on a water tank. If a user forgets to flush the toilet, it may affect the toilet environment and confuse the next user.

SUMMARY

Therefore, an object of the disclosure is to provide a novel automatic flush toilet which may overcome at least one drawback of the prior art.

According to the disclosure, an automatic flush toilet includes a toilet stool, a water tank unit, a first discharge member, a second discharge member, a pipe unit, a flush valve, a manual actuating unit, an electric switching valve, and a sensor control unit. The toilet stool defines therein a toilet bowl. The water tank unit defines therein a water storage space. The first discharge member is mounted to the water tank unit, and defines a first discharge port downstream of the water storage space. The second discharge member is mounted to the water tank unit, and defines a second discharge port downstream of the water storage space. The pipe unit includes a flow-out pipe, a first flow-in pipe, a first connection pipe, and a second flow-in pipe. The flow-out pipe is disposed upstream of the toilet bowl. The first flow-in pipe is disposed downstream of the first discharge port. The first connection pipe is disposed downstream of the first flow-in pipe and upstream of the flow-out pipe. The second flow-in pipe is disposed downstream of the second discharge port and upstream of the flow-out pipe. The flush valve is disposed upstream of the second flow-in pipe, and is switchable between a closed position, where fluid communication between the second flow-in pipe and the water storage space is blocked, and an open position, where the second flow-in pipe and the water storage space are fluidly communicated with each other. The manual actuating unit is coupled to the flush valve for actuating movement of the flush valve from the closed position to the open position. The electric switching valve is connected in series between the first flow-in pipe and the first connection pipe, and is switchable between a blocked state, where fluid communication between the first flow-in pipe and the first connection pipe is blocked, and a communicated state, where the first flow-in pipe and the first connection pipe are fluidly communicated with each other. The sensor control unit is disposed for controlling switching of the electric switching valve between the blocked state and the communicated state.

BRIEF DESCRIPTION OF THE DRAWINGS

Other features and advantages of the disclosure will become apparent in the following detailed description of the embodiment (s) with reference to the accompanying drawings, in which.

DETAILED DESCRIPTION

Figure 1:
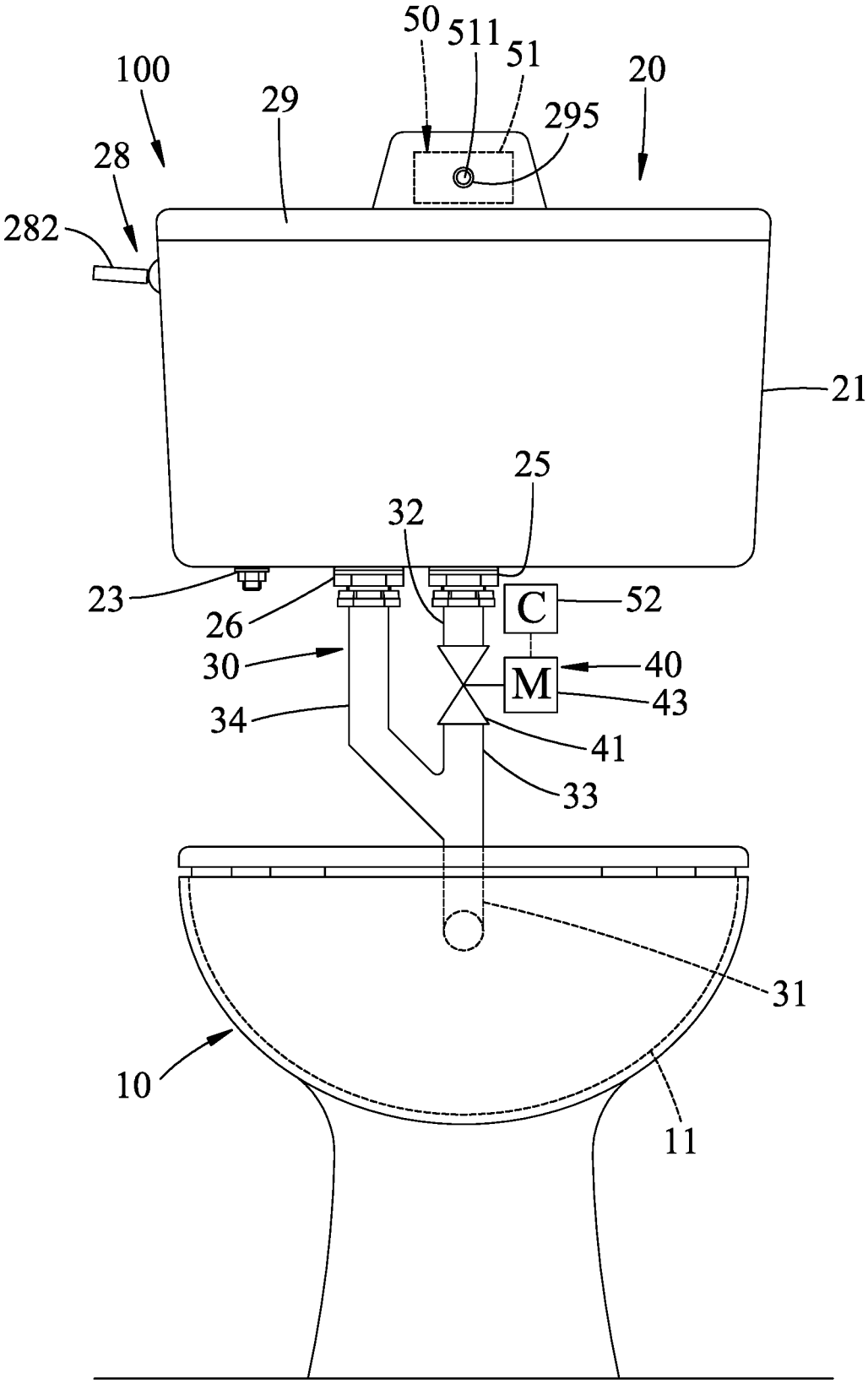
FIG. 1 is a front schematic view of an automatic flush toilet according to a first embodiment of the disclosure.

Before the disclosure is described in greater detail, it should be noted that where considered appropriate, reference numerals have been repeated among the figures to indicate corresponding or analogous elements, which may optionally have similar characteristics.

Figure 2:
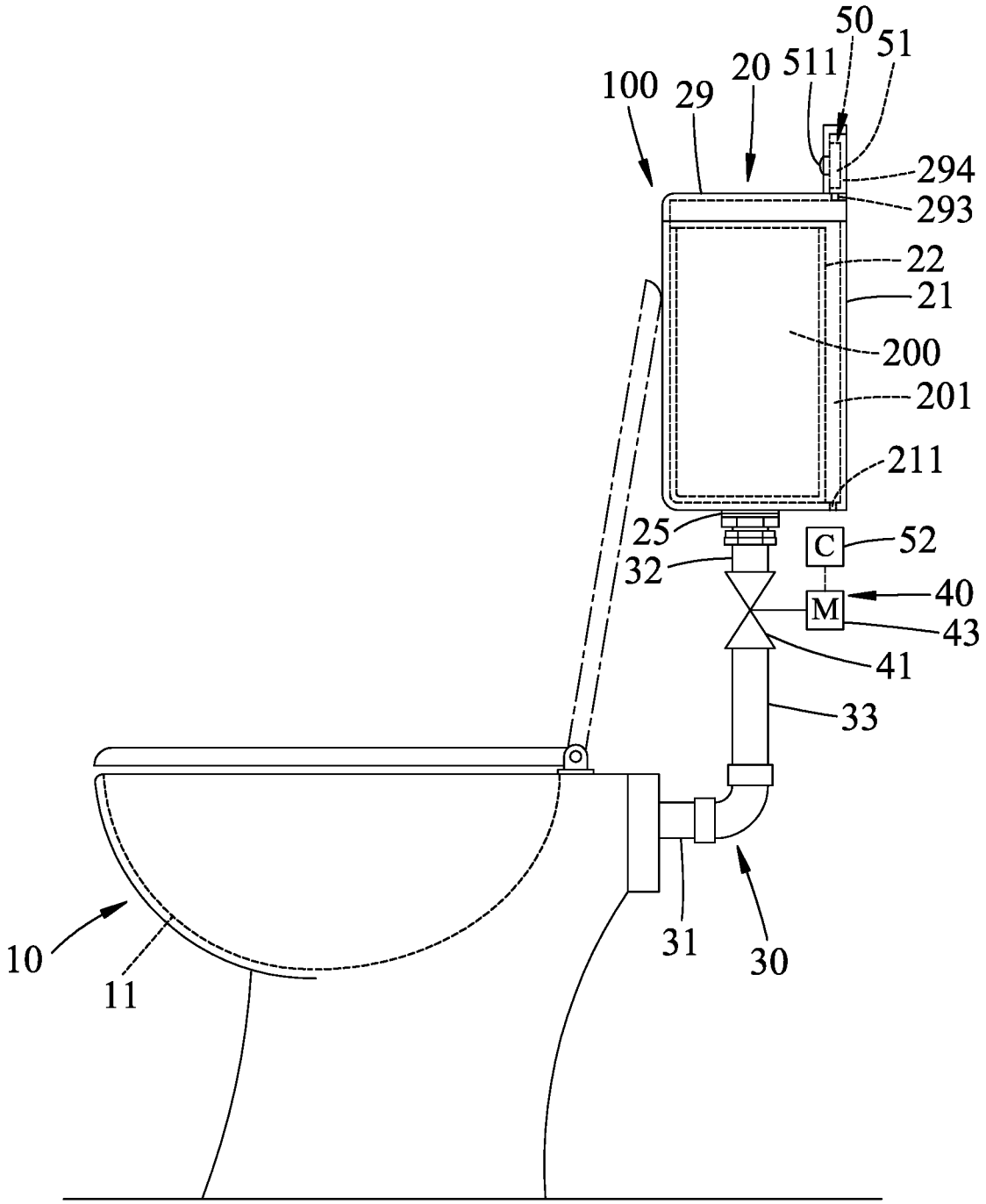
FIG. 2 is a side schematic view of the first embodiment.
Figure 3:
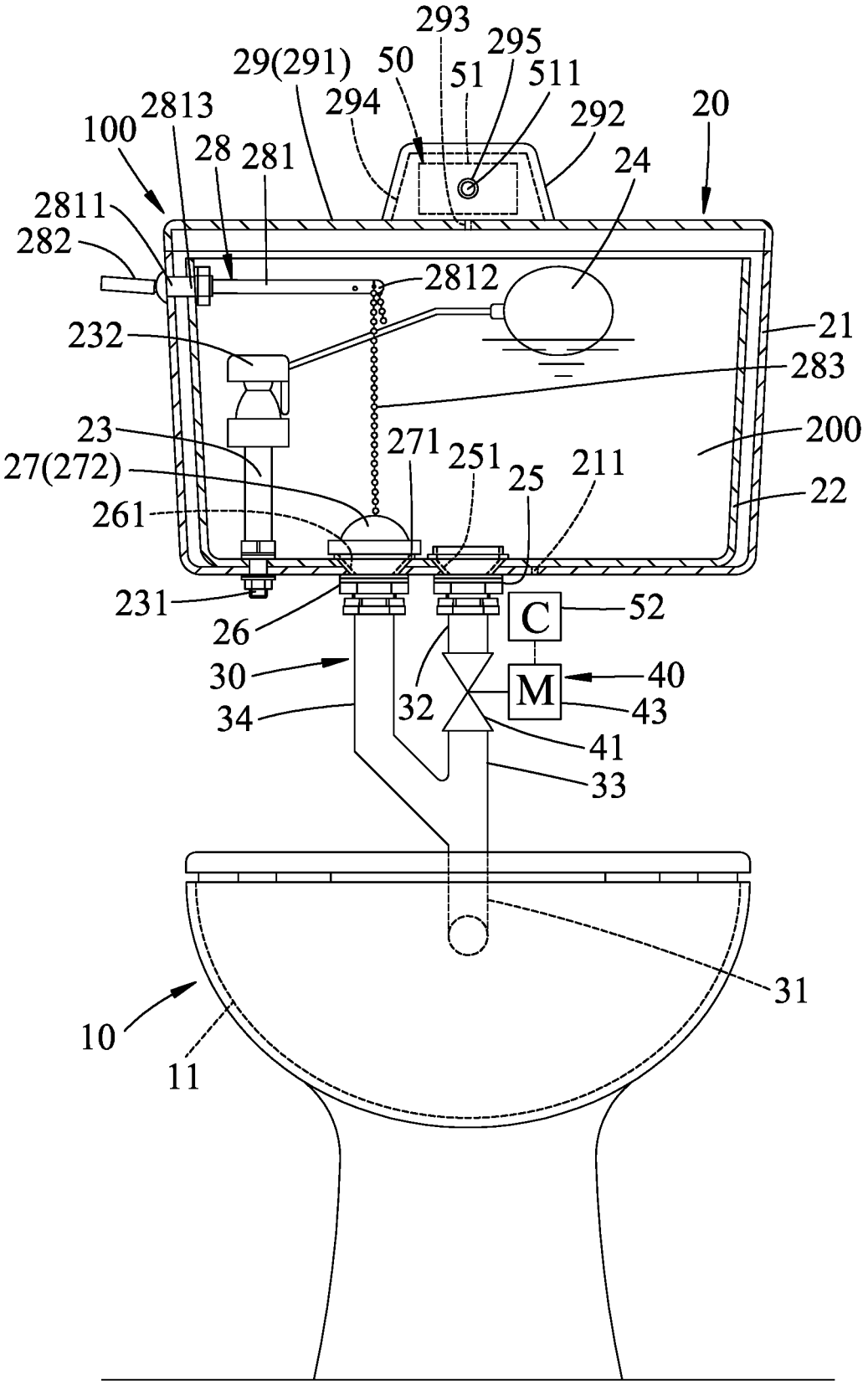
FIG. 3 is a partially cross-sectional schematic view of the first embodiment.

Referring to FIGS. 1 to 3, an automatic flush toilet 100 according to a first embodiment of the disclosure is shown to include a toilet stool 10, a water tank unit 20, a first discharge member 25, a second discharge member 26, a pipe unit 30, an electric switching valve 40, a sensor control unit 50, a flush valve 27, and a manual actuating unit 28.

The toilet stool 10 defines therein a toilet bowl 11.

The water tank unit 20 defines therein a water storage space 200. In the first embodiment, the water tank unit 20 includes an outer tank body 21, and an inner tank body 22 which is disposed inside the outer tank body 21 and which defines therein the water storage space 200.

The outer tank body 21 has a first wire hole 211, and the outer and inner tank bodies 21, 22 define therebetween a clearance 201 (see FIG. 2) for passage of an electric wire (not shown).

In an embodiment shown in FIG. 3, a water inlet valve 23 is mounted inside the water storage space 200 of the water tank unit 20, and has a bottom end 231 extending outwardly of the outer tank body 21 for connection to a water pipe (not shown). In addition, a float ball 24 is disposed to float on the water inside the water storage space 200 and is pivotally movable relative to a top end 232 of the water inlet valve 23 for controlling whether or not water is introduced into the water storage space 200 through the water inlet valve 23.

In an embodiment shown in FIGS. 1 to 3, the water tank unit 20 further includes a cover member 29 which is detachably mounted to a top of the outer tank body 21, and which includes a base segment 291 and an upright segment 292. The base segment 291 is configured to cover the water storage space 200, and has a second wire hole 293. The upright segment 292 extends upwardly from the base segment 291, and defines therein an installation space 294 which is in spatial communication with the second wire hole 293.

The first discharge member 25 is mounted to the water tank unit 20, and defines a first discharge port 251 downstream of the water storage space 200. The second discharge member 26 is mounted to the water tank unit 20, and defines a second discharge port 261 downstream of the water storage space 200.

In an embodiment shown in FIG. 3, the first and second discharge members 25, 26 are separated and mounted on an outer surface of the outer tank body 21. Each of the first and second discharge members 25, 26 extends through the outer and inner tank bodies 21, 22 to permit a respective one of the first and second discharge holes 251, 261 to be disposed downstream of the water storage space 200.

The pipe unit 30 includes a flow-out pipe 31, a first flow-in pipe 32, a first connection pipe 33, and a second flow-in pipe 34. The flow-out pipe 31 is disposed upstream of the toilet bowl 11. The first flow-in pipe 32 is disposed downstream of the first discharge port 251. The first connection pipe 33 is disposed downstream of the first flow-in pipe 32 and upstream of the flow-out pipe 31. The second flow-in pipe 34 is disposed downstream of the second discharge port 261 and upstream of the flow-out pipe 31.

Figure 10:
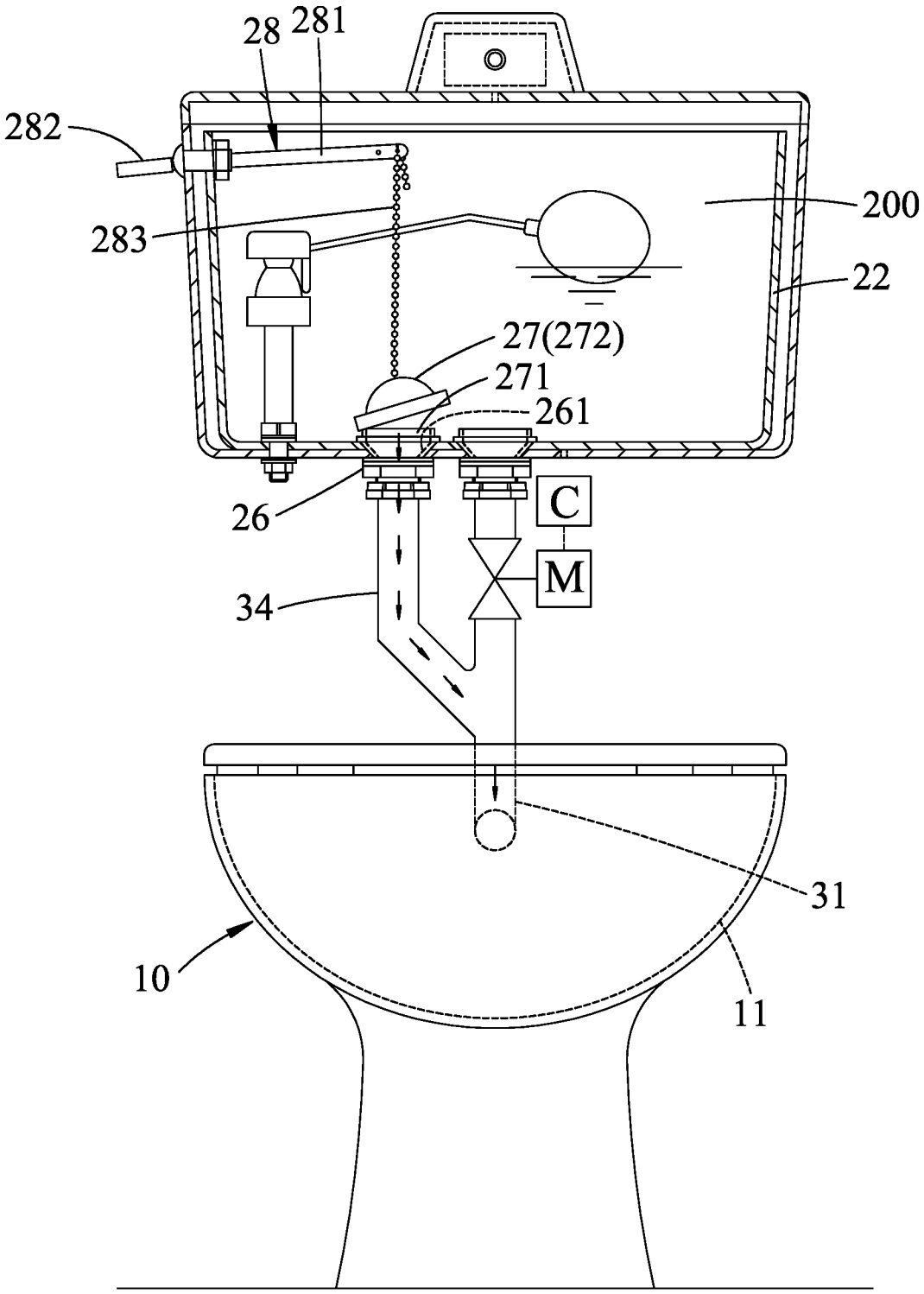
FIG. 10 is similar to FIG. 7 but illustrating the electric switching valve in the blocked state and a flush valve in an open position.

The flush valve 27 is disposed upstream of the second flow-in pipe 34, and is switchable between a closed position (FIG. 3) and an open position (FIG. 10). In the closed position, fluid communication between the second flow-in pipe 34 and the water storage space 200 is blocked. In the open position, the second flow-in pipe and the water storage space 200 are fluidly communicated with each other.

In an embodiment shown in FIGS. 3 and 10, the flush valve 27 includes a valve seat 271 and a flapper 272. The valve seat 271 is disposed in the water storage space 200 and is mounted on an inner surface of the inner tank body 22 to permit the valve seat 271 to be disposed upstream of the second discharge port 261. The flapper 272 is configured such that when the flush valve 27 is in the closed position (FIG. 3), the flapper 272 is disposed to seal the valve seat 271, and such that when the flush valve 27 is in the open position (FIG. 10), the seal between the flapper 272 and the valve seat 271 is broken.

In an embodiment shown in FIGS. 3 and 10, the valve seat 271 is integrally formed with the second discharge member 26.

The manual actuating unit 28 is coupled to the flush valve 27 for actuating movement of the flush valve 27 from the closed position to the open position.

In an embodiment shown in FIG. 3, the manual actuating unit 28 includes a handle 282, a lever 281, and a chain 283. The handle 282 is mounted pivotally on an outside of the outer tank body 21 for manually actuation. The lever 281 is disposed inside the water storage space 200, and is coupled to be actuated by the handle 282. The lever 281 has a power region 2811 coupled to the handle 283, a weight region 2812, and a fulcrum region 2813 disposed between the power and weight regions 2811, 2812. The chain 283 connects the weight region 2813 of the lever 281 to the flapper 272 such that when the handle 282 is manually actuated to operate the lever 281, the chain 283 is pulled by the lever 281 to thereby move the flush valve 27 to the open position from the closed position.

Figure 4:
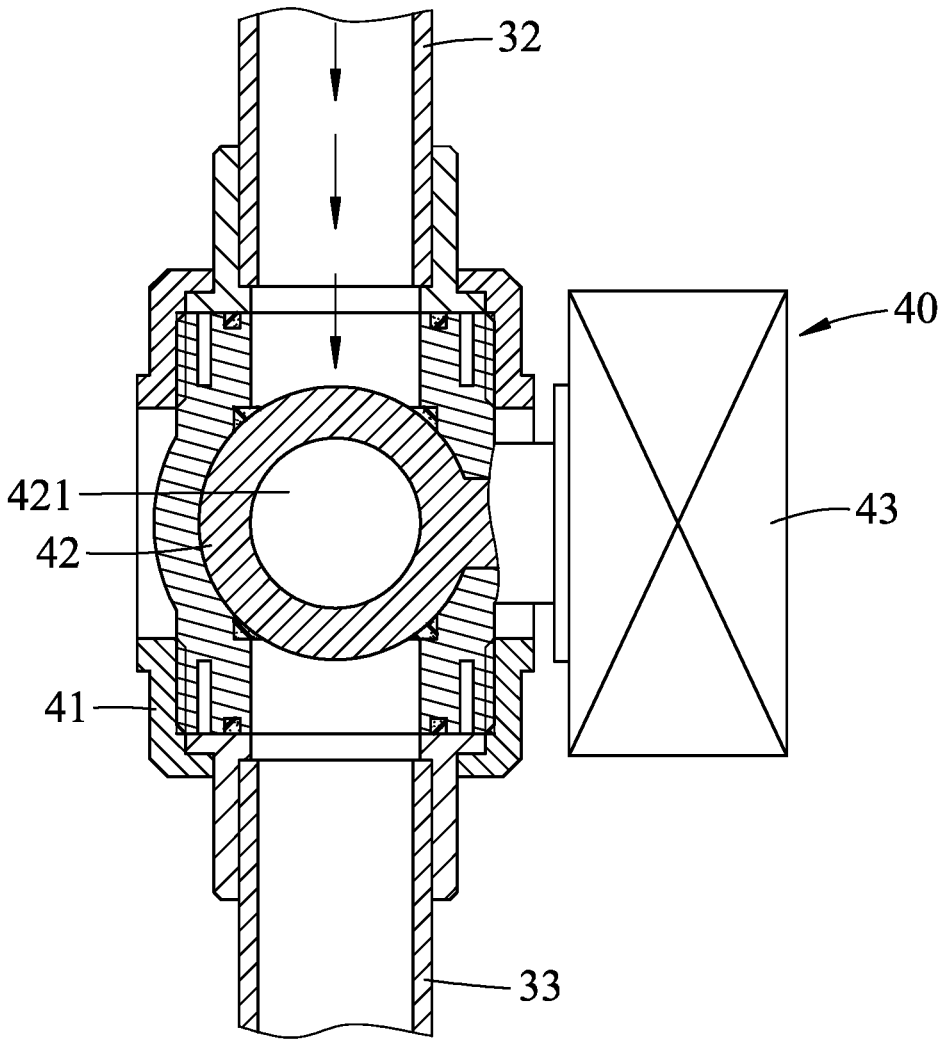
FIG. 4 is a fragmentary, partially cross-sectional view of the first embodiment, illustrating a pipe unit and an electric switching valve which is in a blocked state.
Figure 5:
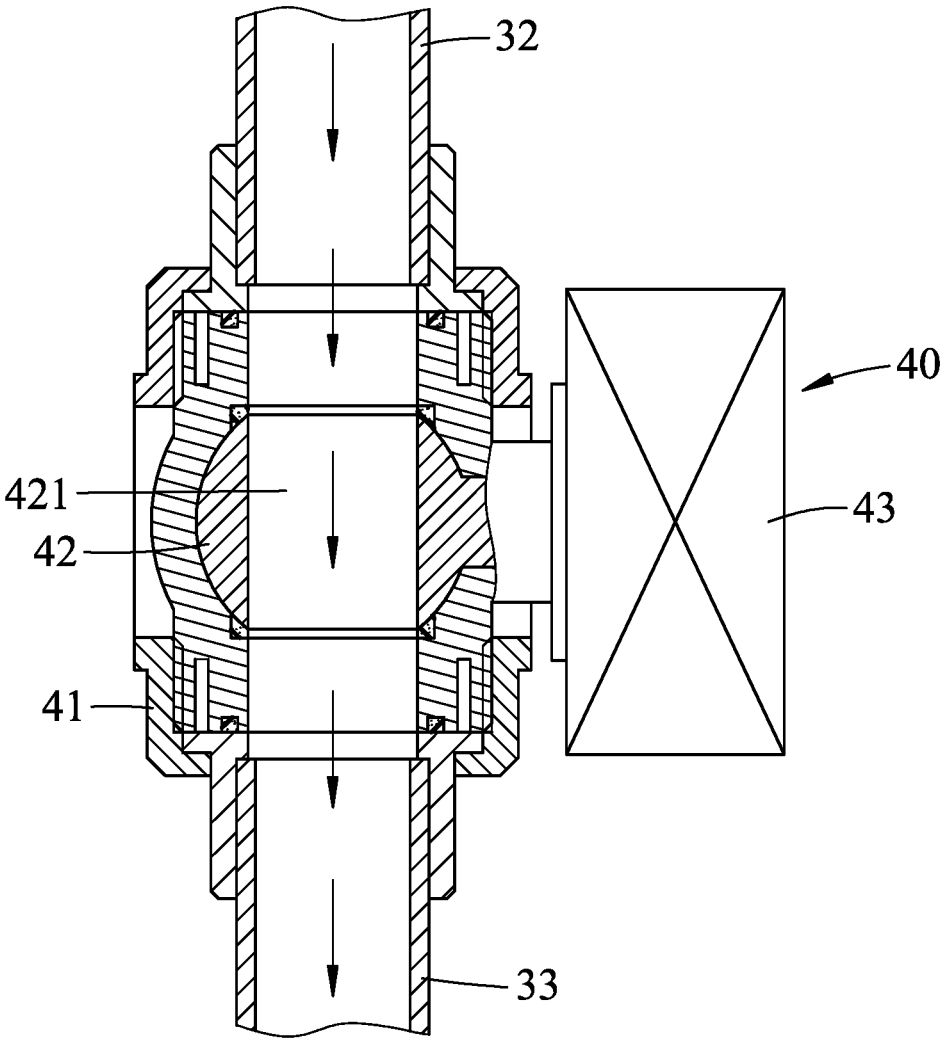
FIG. 5 is similar to FIG. 4 but illustrating the electric switching valve in a communicated state.
Figure 9:
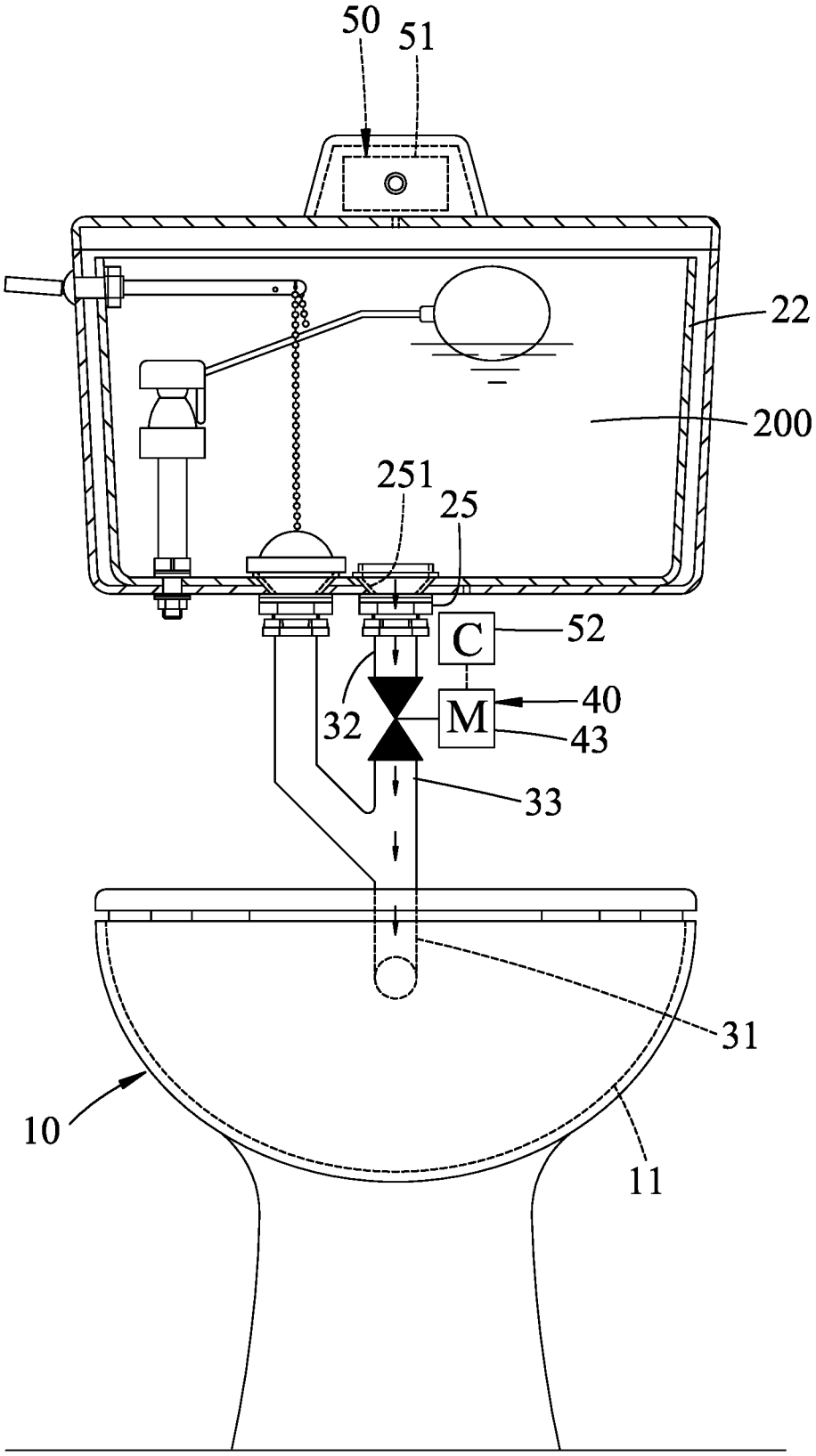
FIG. 9 is similar to FIG. 7 but illustrating the electric switching valve in the communicated state.

The electric switching valve 40 is connected in series between the first flow-in pipe 32 and the first connection pipe 33, and is switchable between a blocked state (FIGS. 4 and 7) and a communicated state (FIGS. 5 and 9). In the first embodiment, as shown in FIGS. 4 and 5, the electric switching valve 40 is an electric ball valve which includes a valve body 41, a valve gate 42, and a drive motor 43. The valve gate 42, which is in the form of a ball, is rollably disposed inside the valve body 41, and has a communication hole 421. The drive motor 43 is disposed on the valve body 41 for driving the rolling of the valve gate 42.

Figure 7:
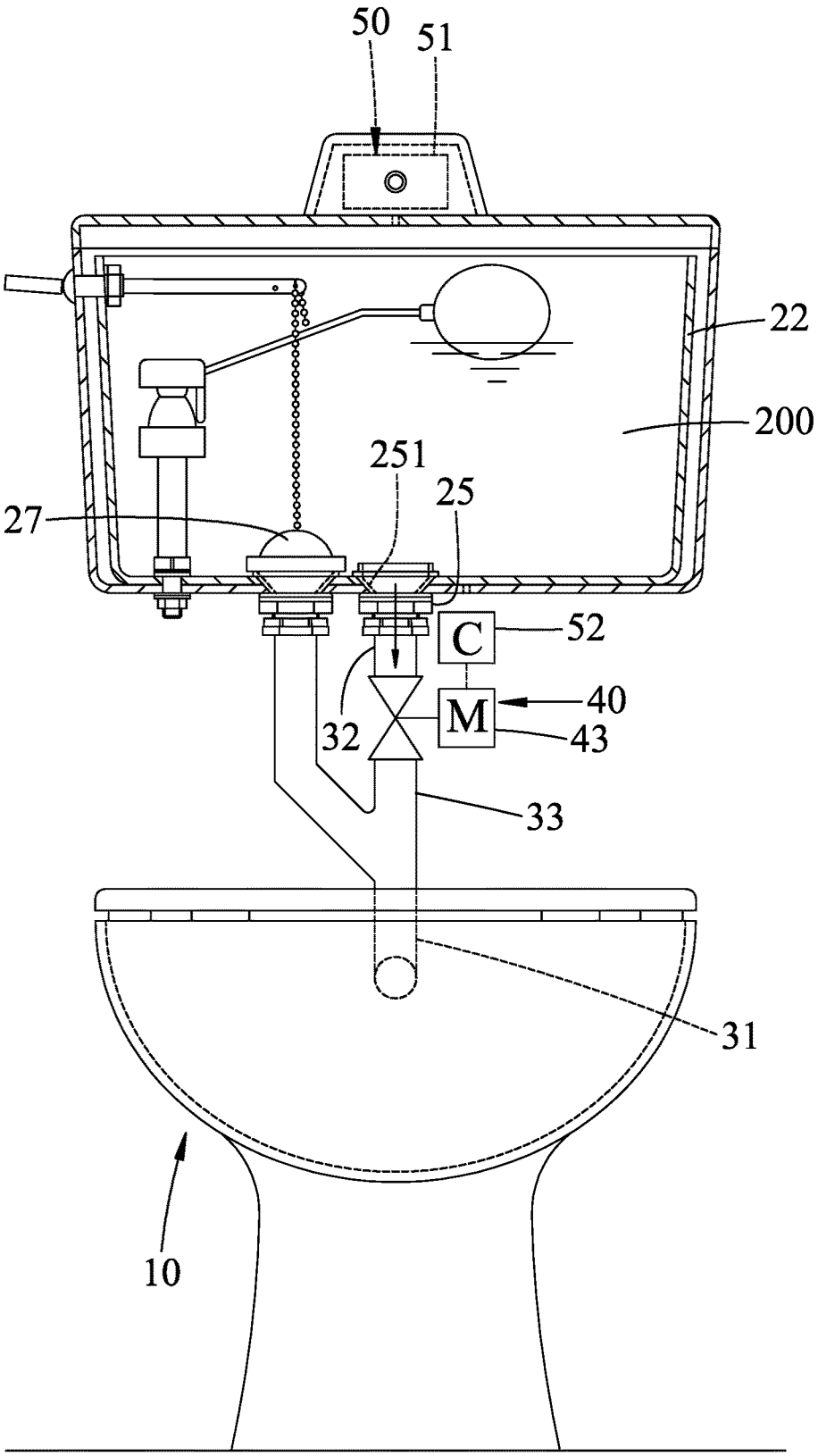
FIG. 7 is similar to FIG. 3 and illustrating the electric switching valve in the blocked state.

As shown in FIGS. 4 and 7, when the electric switching valve 40 is in the blocked state, fluid communication between the first flow-in pipe 32 and the first connection pipe 33 is blocked by the valve gate 42. As shown in FIGS. 5 and 9, when the electric switching valve 40 is in the communicated state, the first flow-in pipe 32 and the first connection pipe 33 are fluidly communicated with each other through the communication hole 421 of the valve gate 42 of the electric switching valve 40.

As illustrated in FIGS. 1 to 3, the sensor control unit 50 is disposed for controlling switching of the electric switching valve 40 between the blocked state (FIGS. 4 and 7) and the communicated state (FIGS. 5 and 9). In the first embodiment, the sensor control unit includes a sensor 51 which is disposed in the installation space 294 of the upright segment 292 of the cover member 29, and a microcomputer control device 52 which is disposed on the electric switching valve 40. The sensor 51 is an ultrasonic sensor or an infrared sensor, and has a sensor head 511 exposed outwardly from a hole 295 of the upright segment 292. The microcomputer control device 52 may be integrally formed with the drive motor 43 of the electric switching valve 40.

In the first embodiment, the microcomputer control device 52 is in signal communication with the sensor 51 and the electric switching valve 40 so as to permit a signal from the sensor 51 to be transmitted to the electric switching valve 40. It can be understood that the microcomputer control device 52 may be in signal communication with the sensor 51 through an electric wire (not shown) which is disposed in the clearance 201 between the outer and inner tank bodies 21, 22 (see FIG. 2), and which has two end segments (not shown) extending respectively through the first and second wire holes 211, 293 for being respectively electrically connected to the microcomputer control device 52 and the sensor 51. In an embodiment, the microcomputer control device 52 may be set to transmit a signal to the drive motor 43 a predetermined time (for example, 3 seconds) after the microcomputer control device 52 has received a signal from the sensor 51. Furthermore, the microcomputer control device 52 may be set to keep the electric switching valve 40 in the communicated state for a predetermined time period (for example, 5 to 10 seconds), thereby controlling a water amount for flushing the toilet bowl 11.

Figure 6:
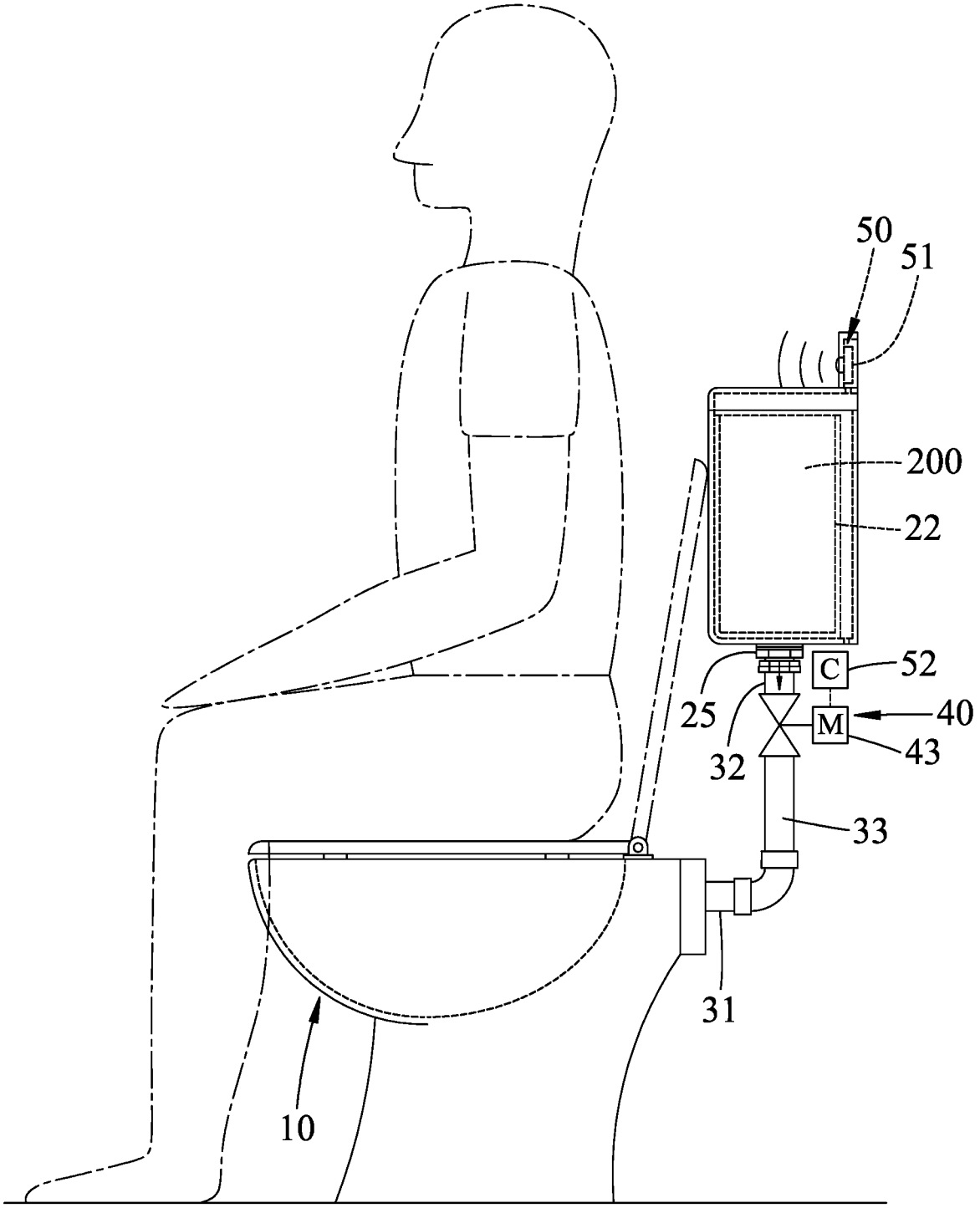
FIG. 6 is similar to FIG. 2 but illustrating a sensor control unit detecting a user on a toilet stool of the first embodiment.

As shown in FIGS. 6 and 7, when the sensor 51 of the sensor control unit 50 detects a user sitting on the toilet stool 10, the sensor 51 transmits a signal to the microcomputer control device 52, and thereafter, the microcomputer control device 52 transmits a signal to the drive motor 43. At this point, the electric switching valve 40 is kept in the blocked state. As such, the water in the water storage space 200 cannot flow into the flow-out pipe 31 through the first discharge port 251 of the first discharge member 25, the first flow-in pipe 32, the electric switching valve 40, and the first connection pipe 33.

Figure 8:
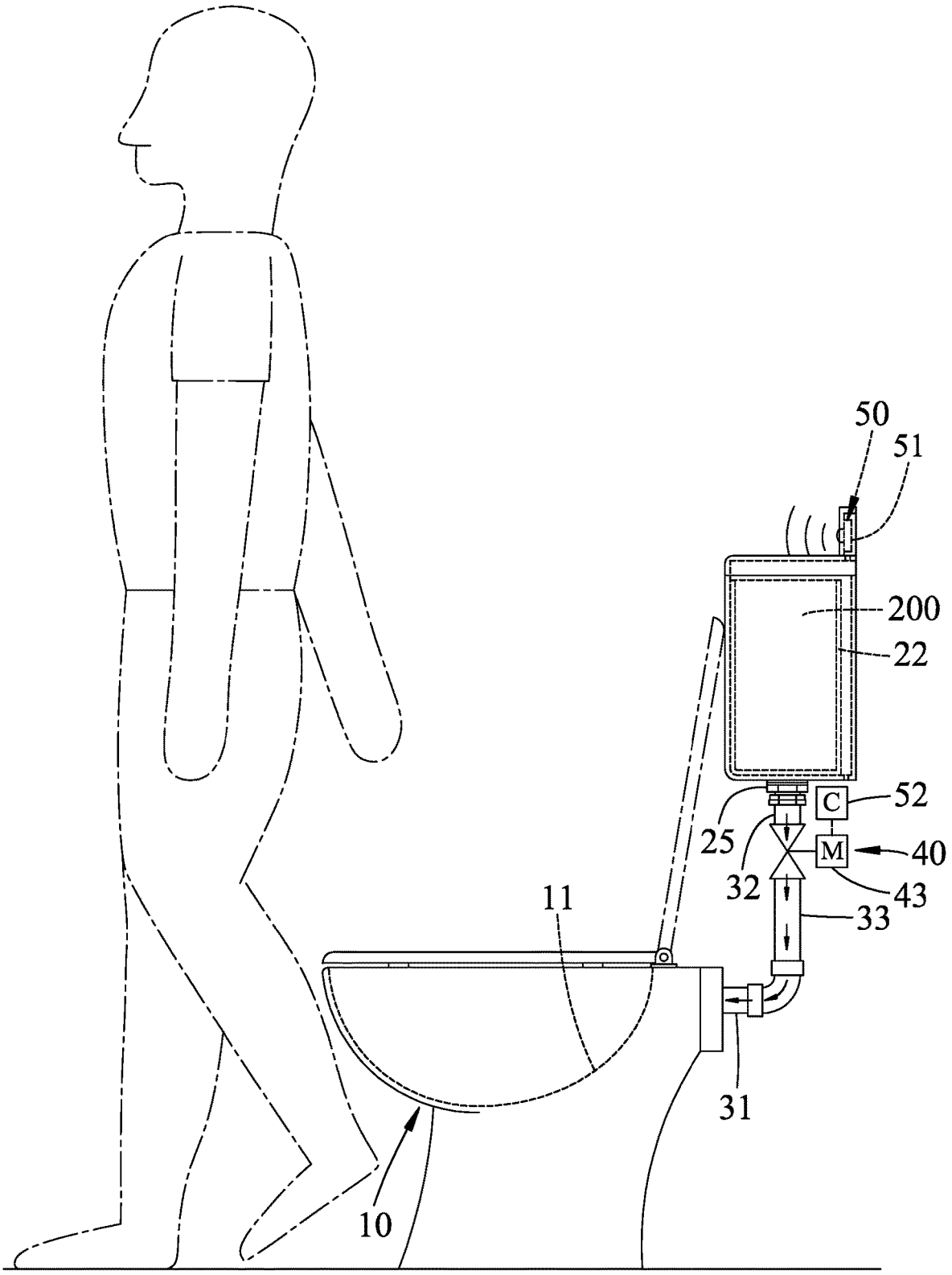
FIG. 8 is similar to FIG. 6 but illustrating the sensor control unit detecting leaving of a user from the toilet stool.

As shown in FIGS. 8 and 9, after the sensor 51 of the sensor control unit 50 detects the user leaving the toilet spool 10, the sensor 51 transmits a signal to the microcomputer control device 52. The microcomputer control device 52 may be set to transmit a signal to the drive motor 43 a predetermined time (for example, 3 seconds) after the microcomputer control device 52 received the signal from the sensor 51, so as to switch the electric switching valve 40 to the communicated state. As such, the water from the water storage space 200 can flow into the flow-out pipe 31 through the first discharge port 251 of the first discharge member 25, the first flow-in pipe 32, the electric switching valve 40, and the first connection pipe 33 for flushing away excreta inside the toilet bowl 11. After a flushing time period, the microcomputer control device 52 emits a signal to switch the electric switching valve 40 back to the blocked state (FIG. 7) so as to stop the flushing. The flushing time period (for example, 5 to 10 seconds) is determined by the time period during which the electric switching valve 40 is kept in the communicated state, and can be controlled by the microcomputer control device 52 to thereby control the water amount for the flushing.

Under a blackout condition, a user can manually press down on the handle 282 of the manual actuating unit 28 to operate the lever 281 and the chain 283, to thereby switch the flush valve 27 to the open position (FIG. 10). In this case, the water in the water storage space 200 can flow into the flow-out pipe 31 through the second discharge port 261 of the second discharge member 26, and the second flow-in pipe 34, thereby flushing excreta inside the toilet bowl 11. After the user releases the handle 282, the flush valve 27 will return to the closed position (FIG. 7) to stop the flushing.

Illustrative advantages of the automatic flush toilet 100 are summarized as follows:

(1) With the provision of the pipe unit 30 in cooperation with the electric switching valve 40, and with the provision of the sensor control unit 50 for automatically controlling the switch of the electric switching valve 40 between the blocked state and the communicated state, automatic flushing effect of the automatic flush toilet 100 can be achieved. Therefore, the automatic flush toilet 100 may be useful for maintaining a clean toilet environment comfortable for the next user.

(2) Under a blackout condition, the manual actuating unit 28 can be manually operated to switch the flush valve 27 to the open position for flushing the toilet bowl 11. Thus, the automatic flush toilet 100 of the disclosure is still workable under the blackout condition.

(3) The communication hole 421 of the valve gate 42 of the electric switching valve 40 has a dimension the same as an inner diameter of each of the flow-out pipe 31, the first flow-in pipe 32, and the first connection pipe 33. Therefore, when the electric switching valve 40 is switched to the communicated state, a sufficient amount of water from the flow-out pipe 31 can be provided for flushing the toilet bowl 11.

(4) The microcomputer control device 52 of the sensor control unit 50 may be set to control the time period during which the electric switching valve 40 is kept in the communicated state, thereby controlling the flushing time period and the water amount for flushing. Therefore, the provision of the microcomputer control device 52 may be useful for water-saving.

Figure 11:
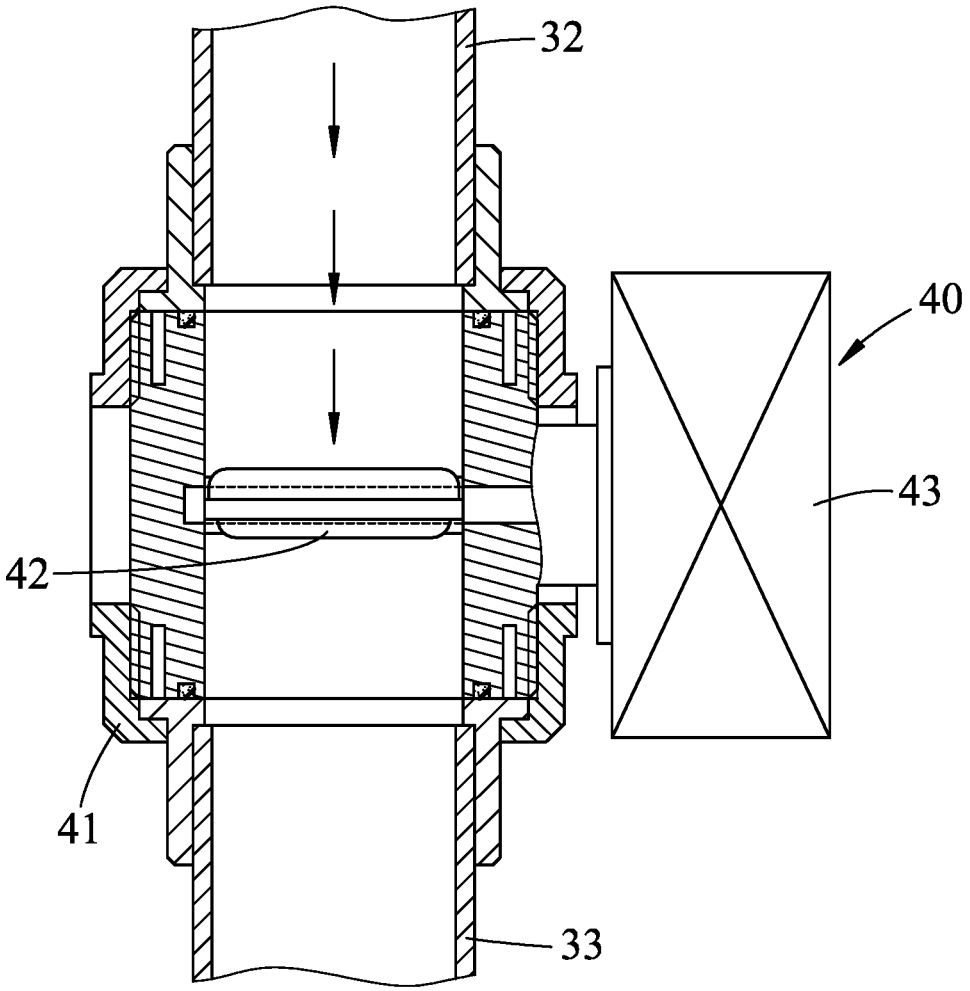
FIG. 11 is similar to FIG. 4 but illustrating an alternative configuration of the electric switching valve in the blocked state.
Figure 12:
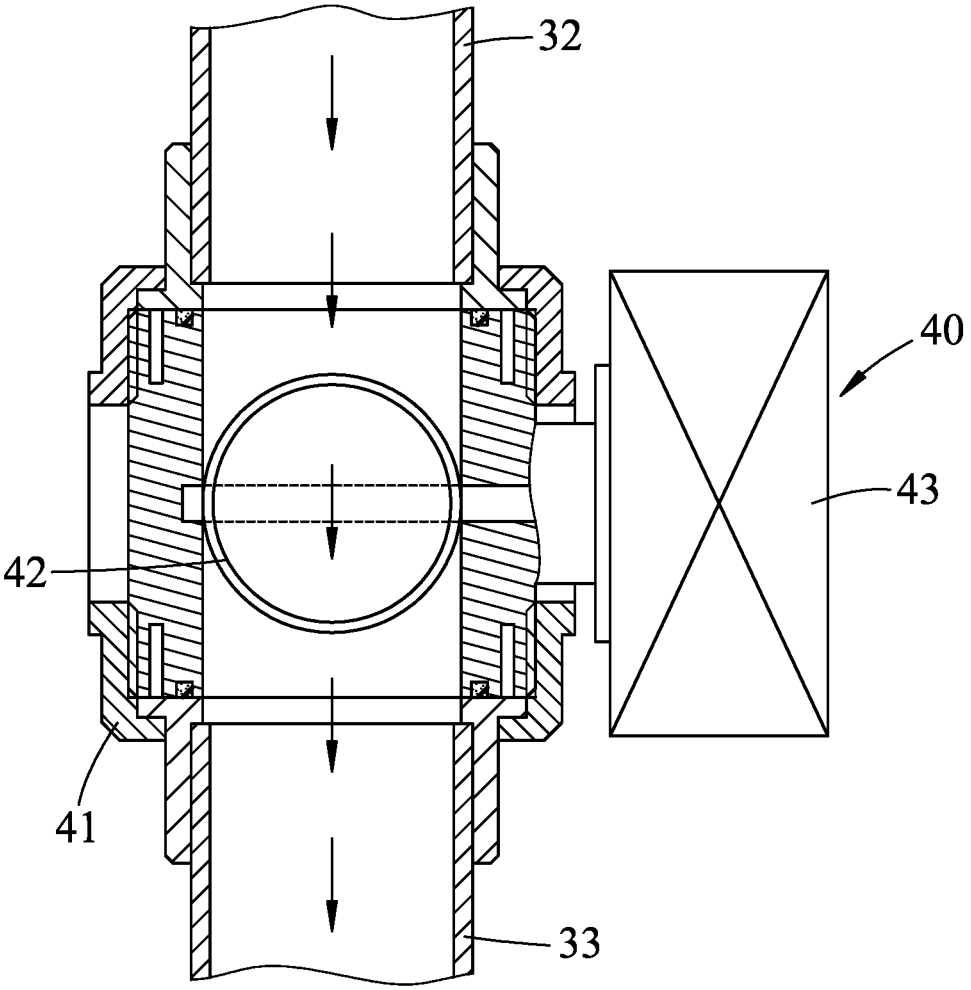
FIG. 12 is similar to FIG. 11 but illustrating the alternative configuration of the electric switching valve in the communicated state.
Figure 13:
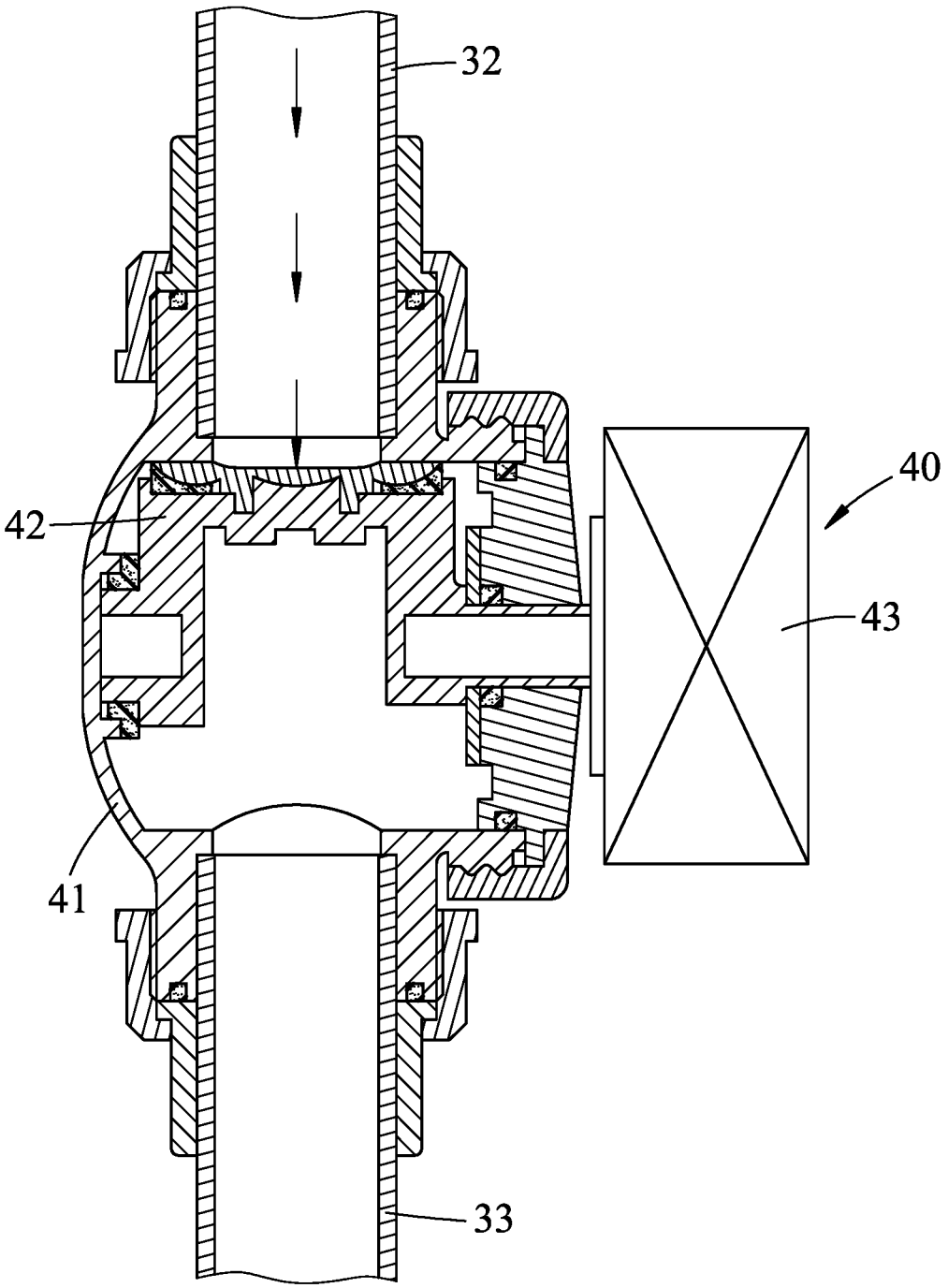
FIG. 13 is similar to FIG. 4 but illustrating another alternative configuration of the electric switching valve which is in the blocked state.
Figure 14:
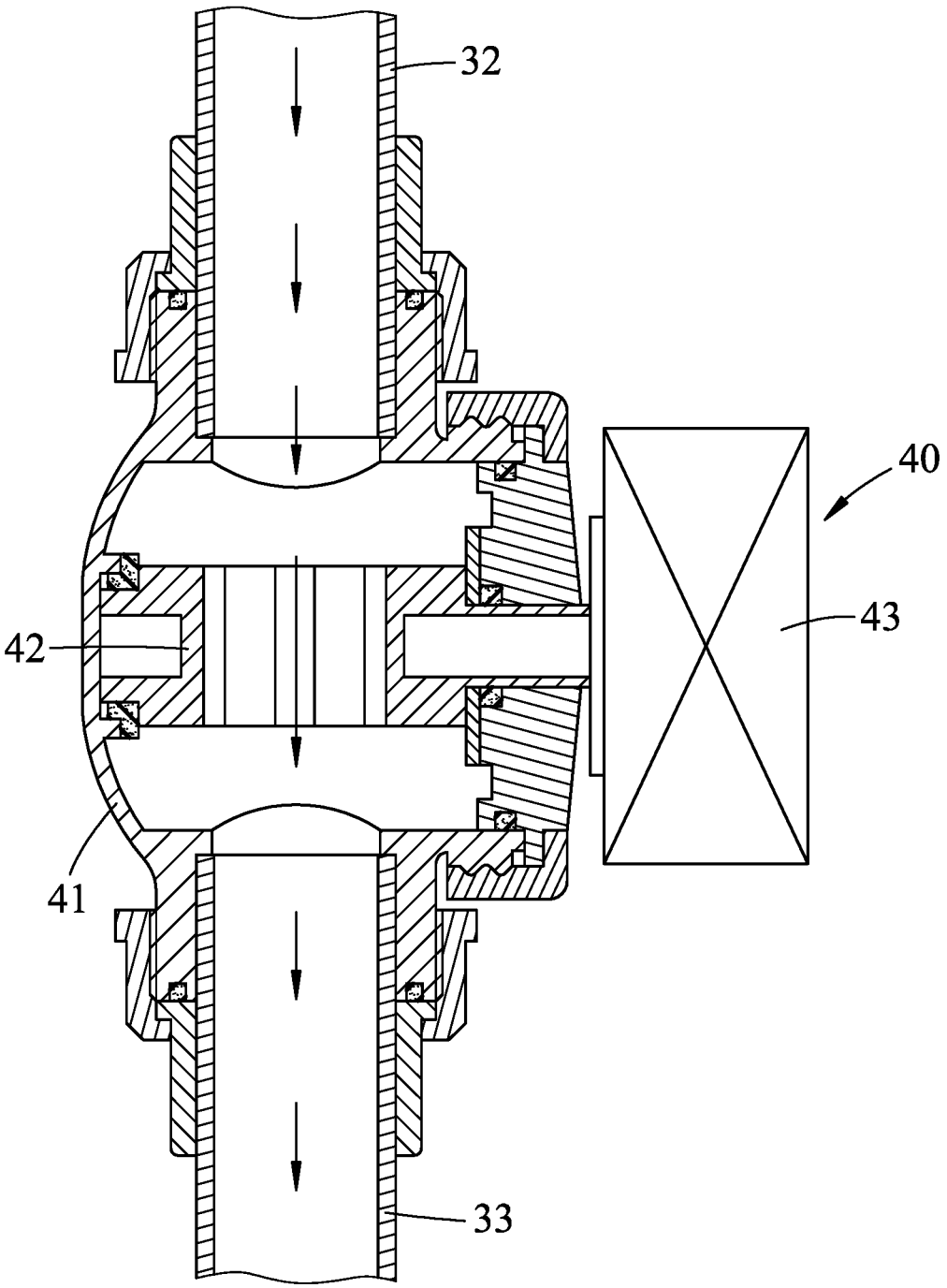
FIG. 14 is similar to FIG. 13 but illustrating the another alternative configuration of the electric switching valve in the communicated state.

In an alternative configuration of the first embodiment, as shown in FIGS. 11 and 12, the electric switching valve 40 is an electric rotary valve with the valve gate 42 in the form of a disc, and is also switchable between the blocked state (FIG. 11) and the communicated state (FIG. 12). In another alternative configuration, as shown in FIGS. 13 and 14, the electric switching valve 40 is an electric plunger valve with the valve gate 42 in the form of a plunger, and is similarly switchable between the blocked state (FIG. 13) and the communicated state (FIG. 14).

Figure 15:
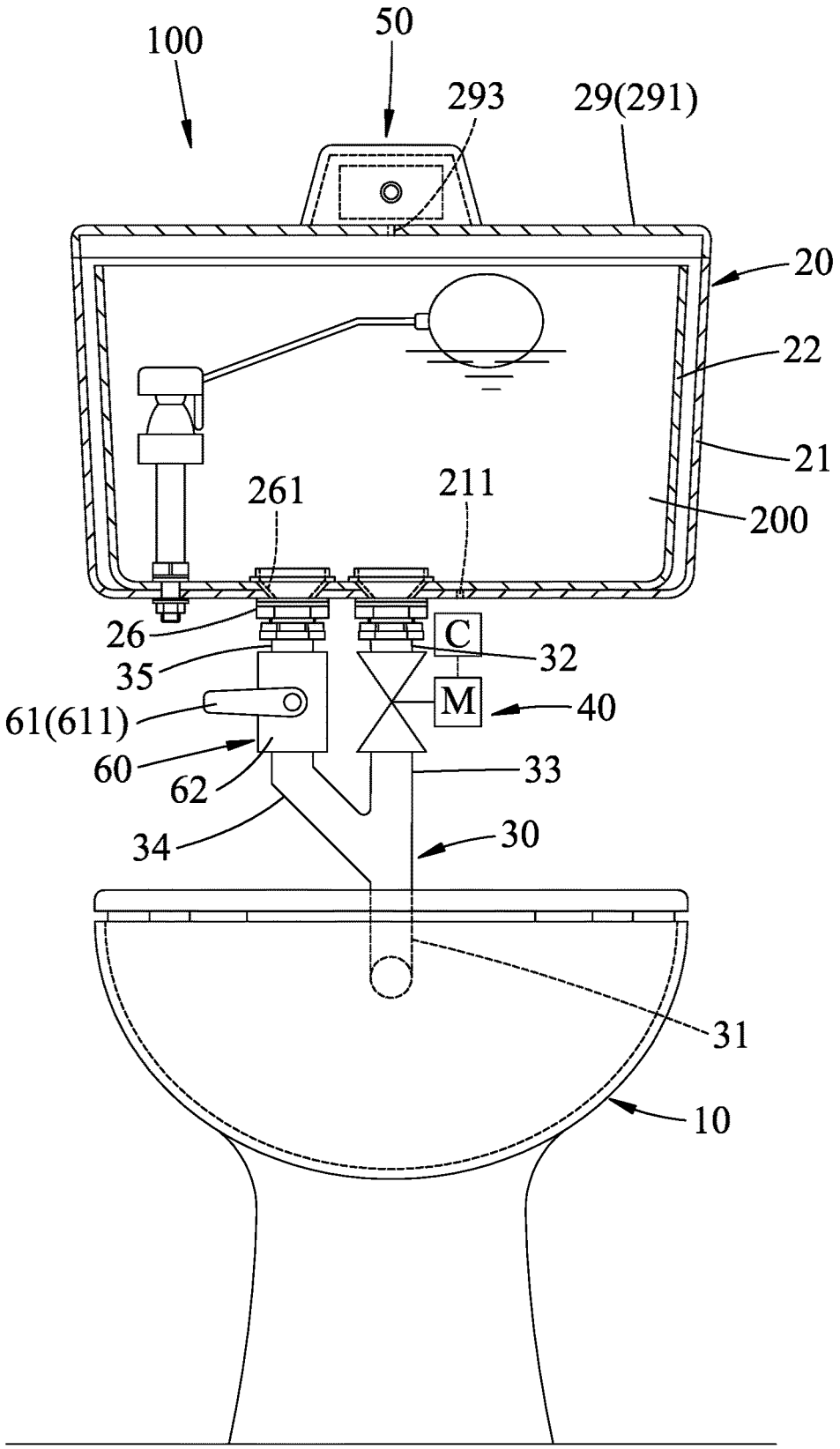
FIG. 15 is a partially cross-sectional schematic view of an automatic flush toilet according to a second embodiment of the disclosure, illustrating a flush valve in a closed position.
Figure 16:
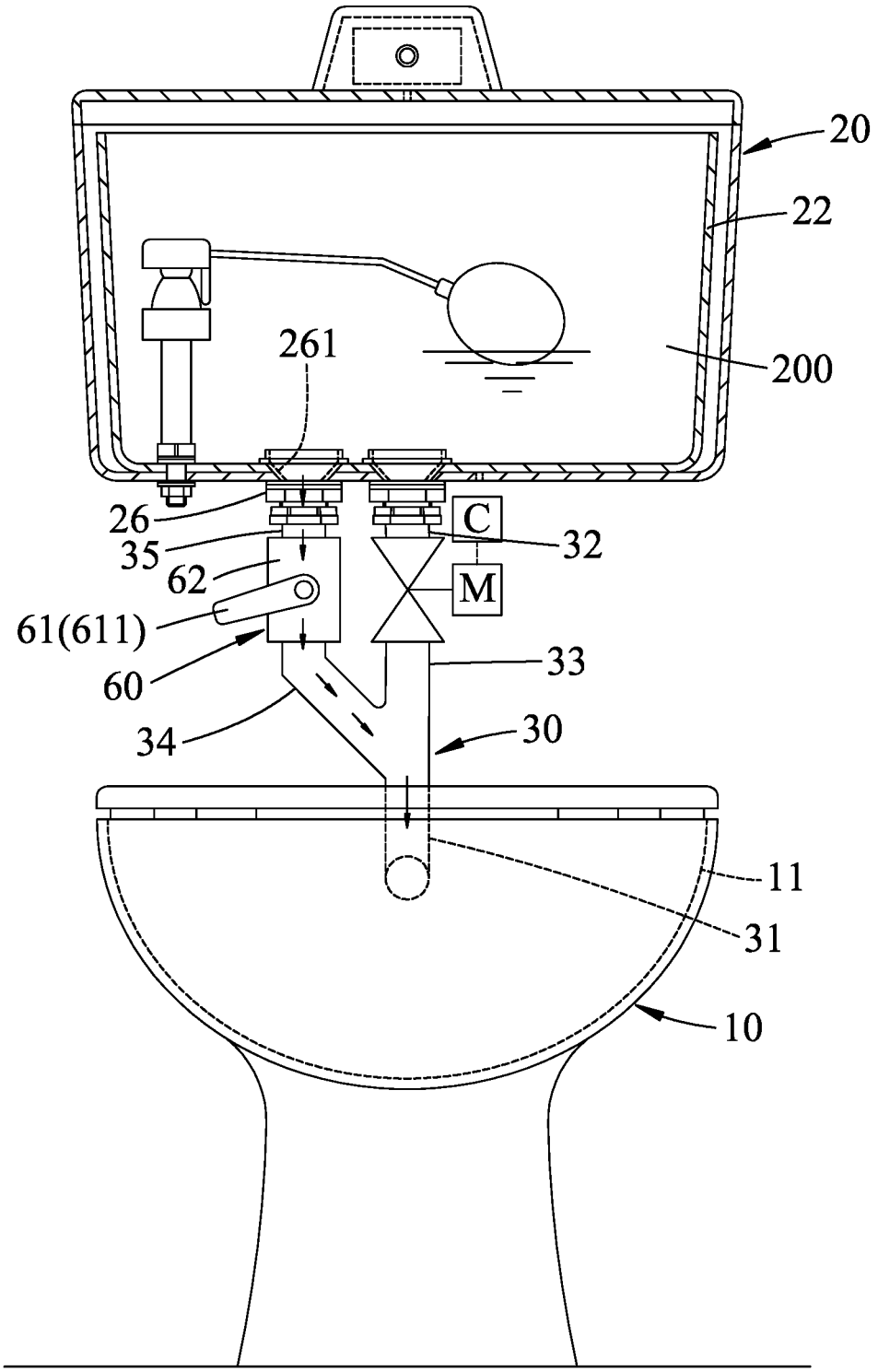
FIG. 16 is similar to FIG. 15 but illustrating the flush valve in an open position.

FIGS. 15 and 16 illustrate an automatic flush toilet 100 according to a second embodiment of the disclosure. The second embodiment is similar to the first embodiment except that in the second embodiment, (i) the pipe unit 30 further includes a second connection pipe 35 disposed downstream of the second discharge port 261 and upstream of the second flow-in pipe 34, and (ii) the flush valve 60 and the manual actuating unit 61 are provided for replacing the flush valve 27 and the manual actuating unit 28 of the first embodiment.

The flush valve 60 is connected in series between the second connection pipe 35 and the second flow-in pipe 34. The manual actuating unit 61 includes an actuating handle 611 which is pivotally mounted to a valve body 62 of the flush valve 60 to switch the flush valve 60 between a closed position (FIG. 15) and an open position (FIG. 16). When the flush valve 60 is in the closed position, fluid communication between the second flow-in pipe 34 and the second connection pipe 35 is blocked (i.e., fluid communication between the second flow-in pipe 34 and the water storage space 200 is blocked). When the flush valve 60 is in the open position, the second flow-in pipe 34 and the second connection pipe 35 are fluidly communicated with each other through the flush valve 60 (i.e., the second flow-in pipe 34 and the water storage space 200 are fluidly communicated with each other).

Under a blackout condition, a user can manually turn the actuating handle 611 of the manual actuating unit 61 to switch the flush valve 60 to the open position (FIG. 16). In this case, the water in the water storage space 200 can flow into the flow-out pipe 31 through the second discharge port 261 of the second discharge member 26, the second connection pipe 35, and the second flow-in pipe 34, thereby flushing excreta inside the toilet bowl 11. Thereafter, the user may turn back the actuating handle 611 to return the flush valve 60 to the closed position (FIG. 15) to stop the flushing. The second embodiment may have advantages of the first embodiment.

Figure 17:
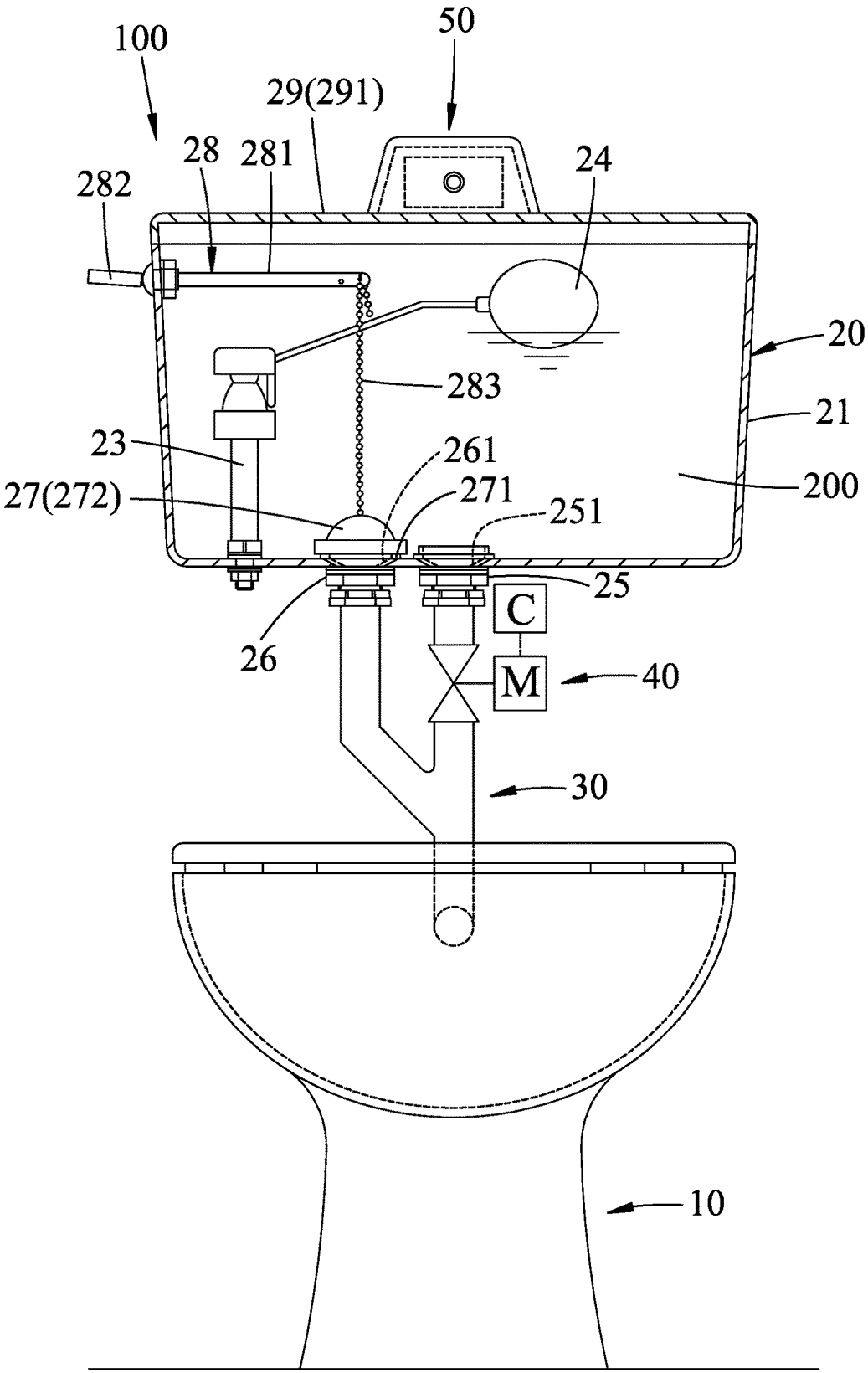
FIG. 17 is a partially cross-sectional schematic view of an automatic flush toilet according to a third embodiment of the disclosure.

FIG. 17 illustrates an automatic flush toilet 100 according to a third embodiment of the disclosure. The third embodiment is similar to the first embodiment except that the inner tank body 22 of the first embodiment is not provided in the third embodiment.

The outer tank body 21 defines therein the water storage space 200. The valve seat 271 of the flush valve 27 is disposed in the water storage space 200 and is mounted on an inner surface of the outer tank body 21 to permit the valve seat 271 to be disposed upstream of the second discharge port 261. Each of the first and second discharge members 25, 26 extends through the outer tank body 21 to permit a respective one of the first and second discharge holes 251, 261 to be disposed downstream of the water storage space 200.

Furthermore, the first wire hole 211 and the second wire hole 293 shown in FIG. 3 are not provided in the third embodiment. The third embodiment may have advantages of the first embodiment.

Figure 18:
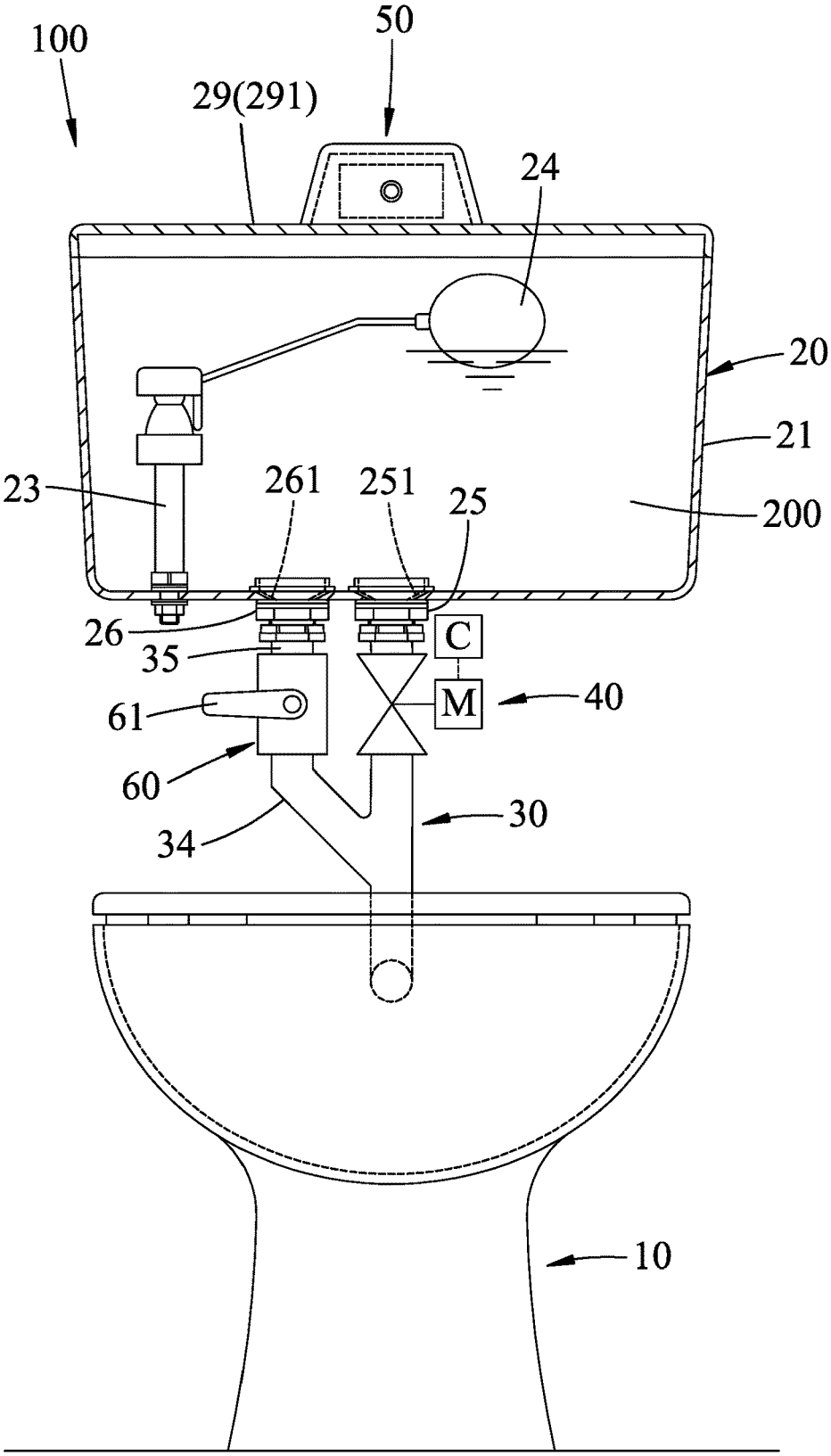
FIG. 18 is a partially cross-sectional schematic view of an automatic flush toilet according to a fourth embodiment of the disclosure.

FIG. 18 illustrates an automatic flush toilet 100 according to a fourth embodiment of the disclosure. The fourth embodiment is similar to the second embodiment except that the inner tank body 22 of the second embodiment is not provided in the fourth embodiment.

The outer tank body 21 defines therein the water storage space 200. Each of the first and second discharge members 25, 26 extends through the outer tank body 21 to permit a respective one of the first and second discharge holes 251, 261 to be disposed downstream of the water storage space 200.

Furthermore, the first wire hole 211 and the second wire hole 293 shown in FIG. 15 are not provided in the fourth embodiment. The fourth embodiment may have advantages of the second embodiment.

In sum, the automatic flush toilet 100 of the disclosure is space-saving, will flush automatically, and is also workable under a blackout condition.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. An automatic flush toilet, comprising:

a toilet stool defining therein a toilet bowl;

a water tank unit defining therein a water storage space;

a first discharge member mounted to said water tank unit, and defining a first discharge port downstream of said water storage space;

a second discharge member mounted to said water tank unit, and defining a second discharge port downstream of said water storage space;

a pipe unit including a flow-out pipe disposed upstream of said toilet bowl, a first flow-in pipe disposed downstream of said first discharge port, a first connection pipe disposed downstream of said first flow-in pipe and upstream of said flow-out pipe, and a second flow-in pipe disposed downstream of said second discharge port and upstream of said flow-out pipe;

a flush valve which is disposed upstream of said second flow-in pipe, and which is switchable between a closed position, where fluid communication between said second flow-in pipe and said water storage space is blocked, and an open position, where said second flow-in pipe and said water storage space are fluidly communicated with each other;

a manual actuating unit which is coupled to said flush valve for actuating movement of said flush valve from the closed position to the open position;

an electric switching valve which is connected in series between said first flow-in pipe and said first connection pipe, and which is switchable between a blocked state, where fluid communication between said first flow-in pipe and said first connection pipe is blocked, and a communicated state, where said first flow-in pipe and said first connection pipe are fluidly communicated with each other; and a sensor control unit disposed for controlling switching of said electric switching valve between the blocked state and the communicated state.

2. The automatic flush toilet according to claim 1, further comprising:

a water inlet valve mounted inside said water storage space, and having a bottom end extending outwardly of said water tank unit; and a float ball disposed inside said water storage space and pivotally movable relative to a top end of said water inlet valve for controlling said water inlet valve.

3. The automatic flush toilet according to claim 1, wherein said sensor control unit includes a sensor, and a microcomputer control device which is in signal communication with said sensor and said electric switching valve so as to permit a signal from said sensor to be transmitted to said electric switching valve.

4. The automatic flush toilet according to claim 3, wherein said sensor is an ultrasonic sensor.

5. The automatic flush toilet according to claim 3, wherein said sensor is an infrared sensor.

6. The automatic flush toilet according to claim 3, wherein said electric switching valve is an electric ball valve.

7. The automatic flush toilet according to claim 3, wherein said electric switching valve is an electric rotary valve.

8. The automatic flush toilet according to claim 3, wherein said electric switching valve is an electric plunger valve.

9. The automatic flush toilet according to claim 3, wherein said water tank unit includes an outer tank body, and an inner tank body which is disposed inside said outer tank body and which defines therein said water storage space; and said first and second discharge members are separated and mounted on an outer surface of said outer tank body, each of said first and second discharge members extending through said outer and inner tank bodies to permit a respective one of said first and second discharge holes to be disposed downstream of said water storage space.

10. The automatic flush toilet according to claim 9, wherein said outer tank body has a first wire hole;

said water tank unit further includes a cover member which is detachably mounted to a top of said outer tank body, and which includes a base segment configured to cover said water storage space, and having a second wire hole, and an upright segment extending upwardly from said base segment, and defining therein an installation space which is in spatial communication with said second wire hole;

said sensor is disposed in said installation space and has a sensor head exposed outwardly from said upright segment; and said microcomputer control device is disposed on said electric switching valve.

11. The automatic flush toilet according to claim 9, wherein said flush valve includes a valve seat disposed in said water storage space and mounted on an inner surface of said inner tank body to permit said valve seat to be disposed upstream of said second discharge port, and a flapper configured such that when said flush valve is in the closed position, said flapper is disposed to seal said valve seat, and such that when said flush valve is in the open position, the seal between said flapper and said valve seat is broken; and said manual actuating unit includes a handle mounted pivotally on an outside of said outer tank body, a lever disposed inside said water storage space, and coupled to be actuated by said handle, and a chain connecting said lever to said flapper such that when said handle is manually actuated to operate said lever, said chain is pulled by said lever to thereby move said flush valve to the open position from the closed position.

12. The automatic flush toilet according to claim 3, wherein said water tank unit includes an outer tank body defining said water storage space therein; and said first and second discharge members are separated and mounted on an outer surface of said outer tank body, each of said first and second discharge members extending through said outer tank body to permit a respective one of said first and second discharge holes to be disposed downstream of said water storage space.

13. The automatic flush toilet according to claim 12, wherein said water tank unit further includes a cover member which is detachably mounted to a top of said outer tank body, and which includes a base segment configured to cover said water storage space, and an upright segment extending upwardly from said base segment, and defining therein an installation space;

said sensor is disposed in said installation space and has a sensor head exposed outwardly from said upright segment; and said microcomputer control device is disposed on said electric switching valve.

14. The automatic flush toilet according to claim 12, wherein said flush valve includes a valve seat disposed in said water storage space and mounted on an inner surface of said outer tank body to permit said valve seat to be disposed upstream of said second discharge port, and a flapper configured such that when said flush valve is in the closed position, said flapper is disposed to seal said valve seat, and such that when said flush valve is in the open position, the seal between said flapper and said valve seat is broken; and said manual actuating unit includes a handle mounted pivotally on an outside of said outer tank body, a lever disposed inside said water storage space, and coupled to be actuated by said handle, and a chain connecting said lever to said flapper such that when said handle is manually actuated to operate said lever, said chain is pulled by said lever to thereby move said flush valve to the open position from the closed position.

15. The automatic flush toilet according to claim 1, wherein said pipe unit further includes a second connection pipe disposed downstream of said second discharge port and upstream of said second flow-in pipe;

said flush valve is connected in series between said second connection pipe and said second flow-in pipe; and said manual actuating unit includes an actuating handle which is pivotally mounted to a valve body of said flush valve to switch said flush valve between the closed and open positions.

* * * * *